US005284422A

United States Patent [19]

Turner et al.

[11] Patent Number: 5,284,422

[45] Date of Patent: Feb. 8, 1994

[54] METHOD OF MONITORING AND CONTROLLING A WELL PUMP APPARATUS

[76] Inventors: John M. Turner, 3860 N. Butler, Apartment 3, Farmington, N. Mex. 87401; Jan L. Nethers, P.O. Box 3521, Farmington, N. Mex. 87499; Robert M. Knight, Box 2659, Santa Fe, N. Mex. 87504

[21] Appl. No.: 963,452

[22] Filed: Oct. 19, 1992

[51] Int. Cl.[5] ..... F04B 49/06

[52] U.S. Cl. ..... 417/18; 417/44 J; 417/53

[58] Field of Search ..... 417/53, 44 J, 18

[56] References Cited

U.S. PATENT DOCUMENTS

| | | | |
|---|---|---|---|
| 3,953,777 | 4/1976 | McKee | 318/474 |
| 3,998,568 | 12/1976 | Hynd | 417/12 |
| 4,370,098 | 1/1983 | McClain et al. | 417/18 |
| 4,473,338 | 9/1984 | Garmong | 417/12 |
| 4,509,901 | 4/1985 | McTamaney et al. | 417/18 |
| 4,541,274 | 9/1985 | Purcupile | 73/151 |
| 4,767,280 | 8/1988 | Markuson et al. | 417/44 |
| 4,795,314 | 1/1989 | Prybella et al. | 417/43 |
| 5,015,151 | 5/1991 | Snyder, Jr. et al. | 417/18 |
| 5,044,888 | 9/1991 | Hester, II | 417/22 |
| 5,064,349 | 11/1991 | Turner et al. | 417/53 |
| 5,076,763 | 12/1991 | Anastos et al. | 417/12 |

*Primary Examiner*—Richard A. Bertsch
*Assistant Examiner*—David W. Scheuermann
*Attorney, Agent, or Firm*—Head & Johnson

[57] ABSTRACT

A method of monitoring and controlling a well pump apparatus having an electric motor that rotates a crank arm having a counterweight thereon, a pivoted walking beam oscillated by the crank arm which reciprocates a sucker rod and a pump between an upstroke and a downstroke. The electric current from the motor is measured periodically between the peak upstroke motor current and the peak downstroke motor current, and the results are then integrated to deduce an analysis current per stroke. The mean of a number of sequential samples of the analysis current per period is calculated and thereafter the standard deviation is calculated. The last sample will be within two standard deviations of the mean or the results will be discarded and new data gathered. The well pump apparatus is stopped if a selected number of consecutive samples fall below a preselected threshold.

16 Claims, 5 Drawing Sheets

2A
110
ARE N ANIS SAMPLES < TRESHOLD SET PT
1A
N
Y
112
GAS LOCK CONDITION?
Y
N
114
PUMPOFF ACHIEVED
STOP PUMP
116
CALIBRATE FILL TIME OPTIMIZER?
3A
Y
N
FILL TIME TIMER TIMED OUT
N
Y
118
70
START INITIALIZE PROGRAM
4A
72
HOA SWITCH IN AUTO?
N
Y
74
START PUMP
1A 3A
120
PUMPOFF ACHIEVED <X MINS AGO?
N
122
RUN PUMP FOR X MINUTES TO INSURE PUMPOFF CONDITION
Y
124
RUN PUMP FOR N PUMP CYCLES AND CALCULATE ANIS NUMBER
126
INCREMENT ANIS SAMPLE COUNTER +1
128
LAST ANIS SAMPLE <X% OF CURRENT SAMPLE?
N
WAIT N MINUTES THEN CONTINUE
Y
CALCULATE FILL TIME
4A

METHOD OF MONITORING AND CONTROLLING A WELL PUMP APPARATUS

BACKGROUND OF THE INVENTION

1. Field of the Invention

The present invention relates to a method of monitoring and controlling a well pump apparatus. In particular, the present invention relates to a method of monitoring and controlling a well pump apparatus wherein the amount of electricity consumed during reciprocation is measured and wherein statistical analysis techniques are applied to determine optimum fill times, to differentiate between fluid pump-off and gas lock, to determine sucker rod failure or counterweight failure, and to determine motor start failure and transmission belt failure.

2. Prior Art

A typical pumping unit utilizes a pivoted walking beam with a horse head at the outer end. Oscillation of the walking beam produces reciprocal motion of sucker rods and thereby reciprocation of a pump at the bottom of a well.

Oil bearing formations are often in subterranean porous rock or sand. A vertical borehole penetrating such a formation constitutes a relatively small cross-sectional area of the entire crude oil porous formation. Seepage of crude oil from a porous rock or sand formation is a fairly slow process.

For this reason, the typical oil well is pumped in cycles. The well is first pumped for a selected length of time sufficient to pump the fluid accumulated in the well bore to the earth's surface. Once the fluid accumulated in the well bore has been pumped out, a fill time is provided to allow more fluid to seep from the formation into the borehole. As the well ages, crude oil is being drained from greater distances in the producing formation, and longer fill time is required. As fluid migrates through the formation, a fluid level is slowly reached at which equilibrium is established, after which no further fluid flows into the well bore regardless of any additional time allowed.

It will thus be appreciated that it is desirable to know how long the well should be pumped, once pumping action is started, in order to extract the fluid accumulated in the well bore. If the pumping action is stopped prematurely, fluid will be left in the well bore, thereby diminishing the overall production of the well. Conversely, if pumping action continues after the fluid accumulated in the well bore has been pumped to the surface (referred to as a "pumped off" condition) the result is substantially increased wear and tear on the equipment as well as waste of energy required to provide the pumping action.

Accordingly, it is desirous to monitor and control a well pump apparatus so that the pumping cycle is properly terminated when the well is pumped off. Additionally, it is important to accurately determine the optimum fill-time between pumping cycles.

Moreover, it is advantageous to be able to monitor a well pump apparatus to distinguish between a pumped off condition and a gas lock condition.

It is additionally advantageous to be able to monitor a well pump apparatus to detect sucker rod failure.

It is additionally advantageous to be able to monitor a well pump apparatus to detect loss of a counterweight or counterweights so that the apparatus may be stopped and repairs made.

Finally, it is advantageous to be able to monitor and control a well pump apparatus to detect a motor start failure or a loss of the drive belt and to initiate action.

SUMMARY OF THE INVENTION

The present invention provides a method of controlling and monitoring a well pump apparatus which is used to reciprocate a string of sucker rods suspended from the lower end of a polish rod. At the lower end of the sucker rods is a pump.

A post structure supports a walking beam at a pivot point. The outer end of the walking beam has a horsehead to which is attached a cable connected to the polish rod. Near the opposite end of the walking beam is a pitman connected at a pivot point. A crank arm is pivotally connected to the pitman. The crank arm is rotated by a gear box which is in turn driven by a pulley drive belt. The drive belt is powered an electrical motor which rotates a shaft. The crank arm also includes a counterweight which offsets the weight of the horsehead and the downward force of the cable attached to the polish rod and the sucker rod.

An electric motor is connected to an electric current sensor which is wired to an analog current input device which is thereafter converted to digital readings and received by a microprocessor.

A counterweight sensor is located adjacent the circular path of the counterweight or counterweights. The counterweight sensor is a magnetic proximity sensor that causes an interrupt each time the counterweight passes the sensor mechanism. The sensor is wired to a discrete input which in turn communicates to the microprocessor. A motor control relay start and stop mechanism is wired to the motor and is controlled by the microprocessor through a discrete contact output.

By analyzing cumulative motor current between the peak upstroke motor current and the peak downstroke motor current, the amount of work being done by the pump well apparatus can be determined and control decisions based on this data can be made.

A series of procedures are performed including a failure detection and alarm subroutine. A sucker rod failure or part is known to impart a gross out-of-balance condition to the well pump apparatus. In that event, the motor is presented with the task of lifting counterweights without the benefit of the weight of the rod string. If this occurs, the peak motor current is much different on the upstroke versus the downstroke. If the peak motor currents are more than a set percentage different, the motor is stopped immediately and an alarm is activated.

A similar provision to detect a counterweight loss or movement is made. If the counterweights work their way off the crank arm, the well pump apparatus becomes more and more out-of-balance. The maximum amplitude of the upstroke motor current peak will be much higher than the maximum amplitude of the downstroke motor current peak. If the peak motor currents are more than a set percent different, the microprocessor will activate the relay mechanism and stop the motor immediately and activate an alarm.

The loss of a drive belt will also be detected. After the microprocessor has started the motor and the current is a non-zero value, there should be a modulated current during the stroke. If changes in the motor current are not sensed, the relay mechanism will stop the motor and an alarm will be activated.

The counterweight sensor is thereafter utilized to determine the beam angle of the crank arm. Physical placement of the sensor ensures activation at the start of the downstroke.

A motor current value is acquired every ten milliseconds by the electrical current sensor. This data is stored in the microprocessor. Peak upstroke motor current and the peak downstroke motor current is thus determined.

The sum of the motor current values obtained between the upstroke and downstroke current peaks is then calculated. The sum of the motor currents is then divided by the number of samples taken between the upstroke peak and the downstroke peak to derive an analysis current per stroke value (ANIS).

Continuous sequential ANIS values are derived and stored in the microprocessor in a first in, first out form. The standard deviation of the ten ANIS values is calculated following which the mean or average of the ten values is calculated. If the last derived ANIS value is less than two standard deviations from the mean, that ANIS value will be considered statistically valid and will be used by the algorithm for control decisions. If the last ANIS value is greater than two standard deviations from the mean, the ANIS value will be considered invalid.

If the ANIS value is valid, a pump-off detection procedure is performed. A set point has been programmed either by the operator or previously established values in advance. If the last ANIS value or values are not less than the threshold set point, the value will not be used for a pump-off determination.

Upon a sufficient number of consecutive ANIS value following below a preselected threshold, the well is deemed to be in a pumped-off condition. At this point, the relay mechanism is activated to turn off the motor.

An optimal fill time may also be calculated and the pump apparatus controlled accordingly.

After the pumped off condition wherein the motor is stopped, pumping action is delayed for a uniform short time period. After this uniform short length of time, the microprocessor will activate the relay mechanism to start the motor and the pump apparatus will operate through a number of strokes or cycles. An ANIS value will be determined. A second period of delay occurs, the motor is again restarted and a ANIS value calculated. Sequence is followed to collect ANIS values periodically and incremented sequentially. Periodic sequential values are compared to each other and the difference between the most current value and the previous value obtained is noted. As the fill time continues, the ANIS values come closer and closer to one another. When the last ANIS value is less than a percentage different from the current value, the fill time has been optimized. The fill time is calculated and the motor will be started to begin the entire cycle again.

DETAILED DESCRIPTION OF THE PREFERRED EMBODIMENT

Figure 1:
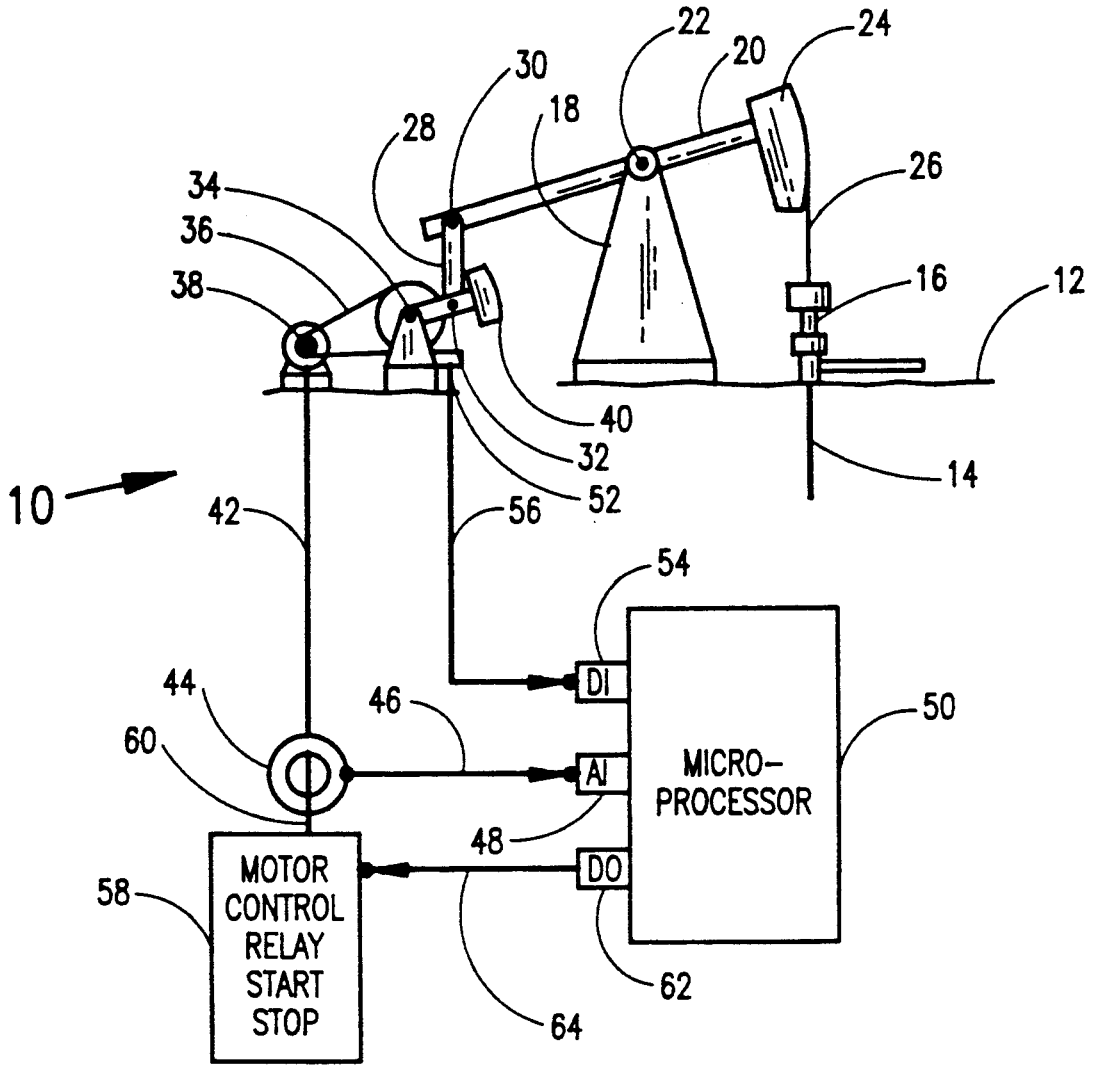
FIG. 1 is a simplified diagrammatic representation of a well pump apparatus incorporating the present invention.

Referring to the drawings in detail, FIG. 1 is a simplified diagrammatic representation of a well pump apparatus 10 incorporating the present invention.

The well pump apparatus 10 is typically located at the surface 12 of the earth. The well pump apparatus is used to reciprocate a string of sucker rods 14 suspended from the lower end of a polish rod 16. At the lower end of the sucker rods, within a tubing string, is a pump (not shown). Reciprocation of the pump causes fluid from the borehole to be forced up to the surface of the earth.

A post structure 18 supports a walking beam 20 at a pivot point 22. The outer end of the walking beam 20 has a horse-head 24 to which is attached a cable 26 connected to the polish rod 16.

Near the opposite end of the walking beam 20 is a pitman 28 connected at pivot point 30. A crank arm 32 is pivotally connected to the pitman. The crank arm 32 also includes a counterweight 40 which offsets the weight of the horsehead 24 and the downward force of the cable 26 attached to the polish rod and sucker rods.

The crank arm is rotated by a gear box 34 driven by a pulley-drive belt 36. The drive belt is powered by an electrical motor 38 which rotates a shaft. The electrical motor connected to is an electrical supply (not shown).

An electrical motor 38 is connected by electric line 42 to an electric current sensor 44. In the present embodiment, the current sensor 44 is measuring current within a range of 0 to 175 amperes alternating current and sensitive to two millivolts per ampere. The current sensor 44 is wired via line 46 to an analog current input 48 which is thereafter converted to digital readings received by a microprocessor 50.

A counterweight sensor 52 is located adjacent the circular path of the counterweight or counterweights 40. The counterweight sensor is a magnetic proximity sensor that causes an interrupt when the counterweight or counterweights pass the sensor mechanism. When the counterweight passes the sensor, it marks the approximate beginning of the upstroke. The counterweight sensor 52 is wired to a discrete input 54 via line 56 which, in turn, communicates to the microprocessor 50.

A motor control relay start and stop mechanism 58 is wired to the motor 38 via a line 60 and line 42. The relay mechanism 58 is controlled by the microprocessor 50 through a discrete contact output 62 from the microprocessor to the relay mechanism via line 64.

The proximity sensor 52 generates an interrupt at the beginning of each upstroke. The proximity sensor provides a trigger to signify a new stroke.

A complete traversal of the walking beam 20 from the beginning of one upstroke through the downstroke and to the beginning of the next stroke is defined as a "stroke".

The amount of electricity consumed during the revolution of the crank arm or the "stroke" will vary. By analyzing cumulative motor current between the peak upstroke motor current and the peak downstroke motor current which is known to translate roughly between 90° and 270° of the angle of the crank, the amount of work being done by the pump well apparatus can be determined and control decisions based on this data can be made.

Figure 2:
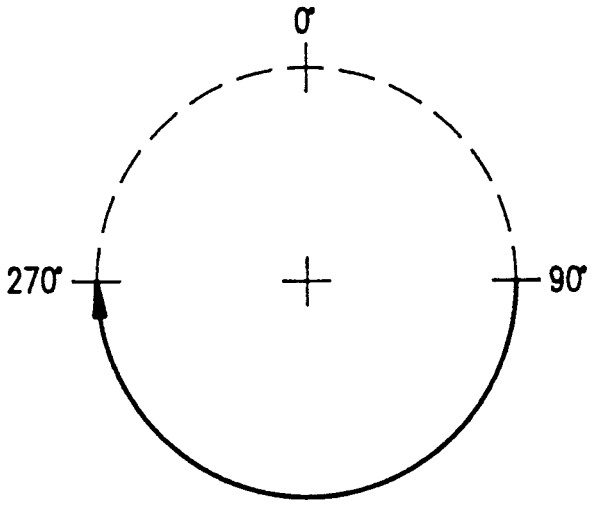
FIG. 2 shows the movement of the crank arm of the well pump apparatus.

FIG. 2 illustrates the movement of the crank arm rotationally. It has been observed that the peak up stroke motor current and the peak downstroke motor current will be generally between the 90° and the 270° rotational position.

FIGS. 3A, 3B, 3C, 3D and 3E illustrate a simplified flow chart of the process of the present invention. Since the control and monitoring system of the present invention is continuous, it will be appreciated that the steps taken during the process will be repeated.

Figure 3A:
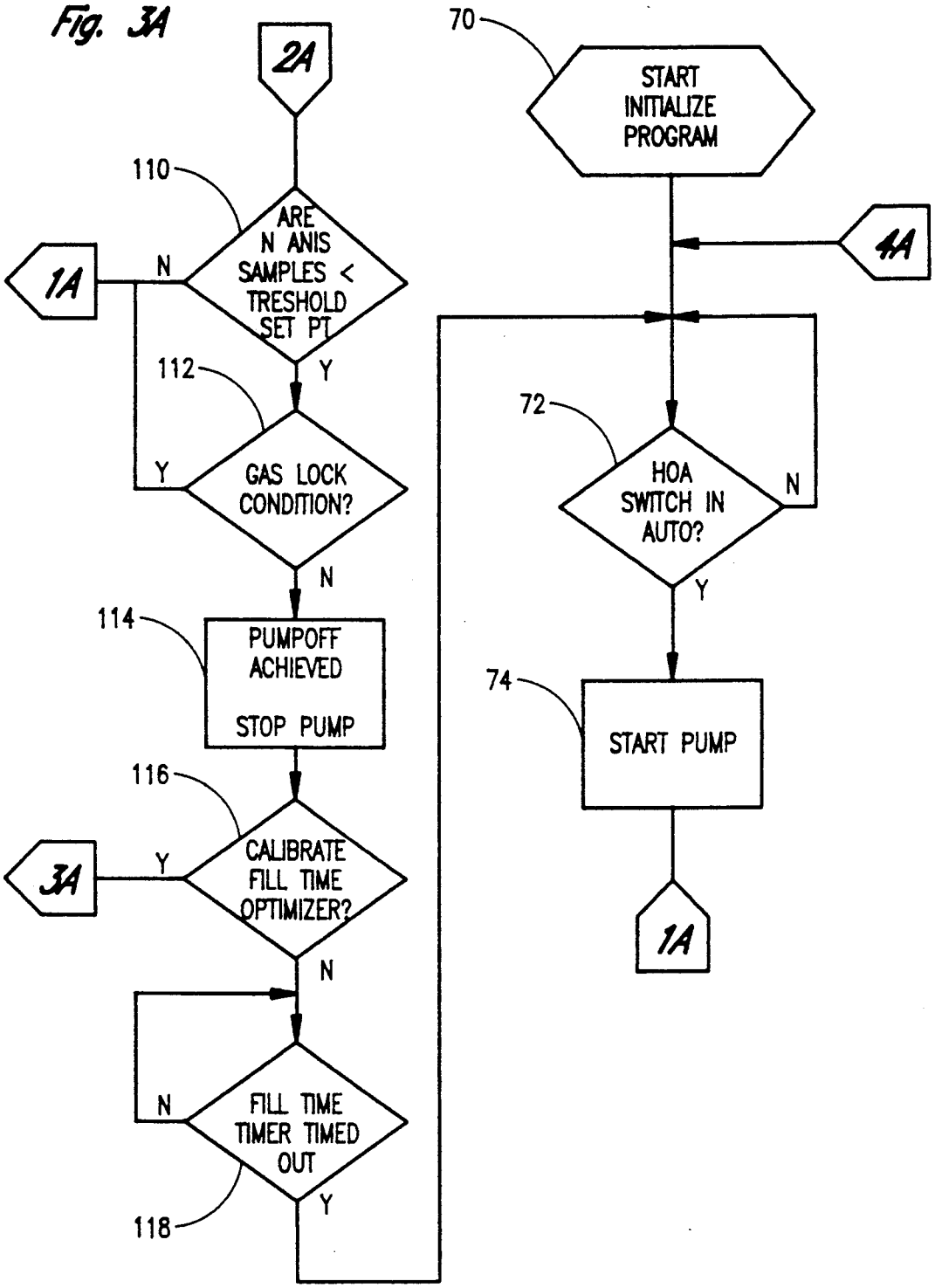
FIG. 3A, 3B, 3C, 3D and 3E illustrate a simplified flow chart of the process of the present invention.

FIG. 3A begins with an initialized start command 70. The program is thereby initialized. A user password may be required to be entered to proceed past this point.

Thereafter, the operator interface mode depicted on box 72 determines if the process will proceed. The operator interface mode determines what command may be entered by the operator and what modes the microprocessor may take. When the operator interface is in the auto mode or "A", the microprocessor may assume any mode and the operator (not shown) is restricted as to the commands that can be entered. Conversely, when in the manual or hand mode depicted as "H", the operator (not shown) may enter any command but the microprocessor is restricted as to the modes it may assume. Finally, an "OFF" or "O" mode may be taken.

In summary, the "HOA" switch must be in the auto position to proceed. If the switch is in the auto position, the motor for the pump will be started as depicted in box 74. For safety purposes, an audible alarm may be provided at the well pump apparatus site prior to starting the motor.

Figure 3B:
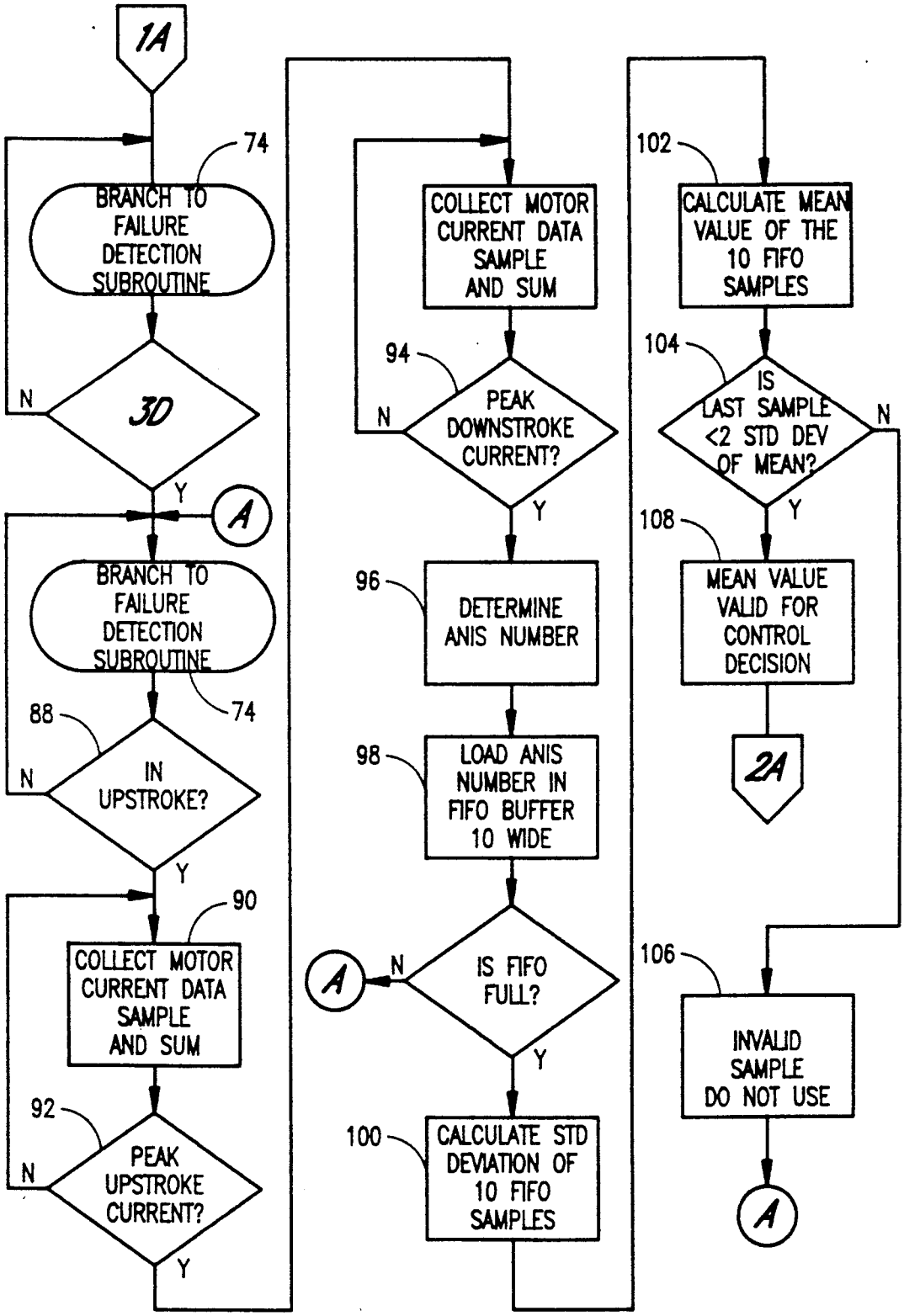
Figure 3C:
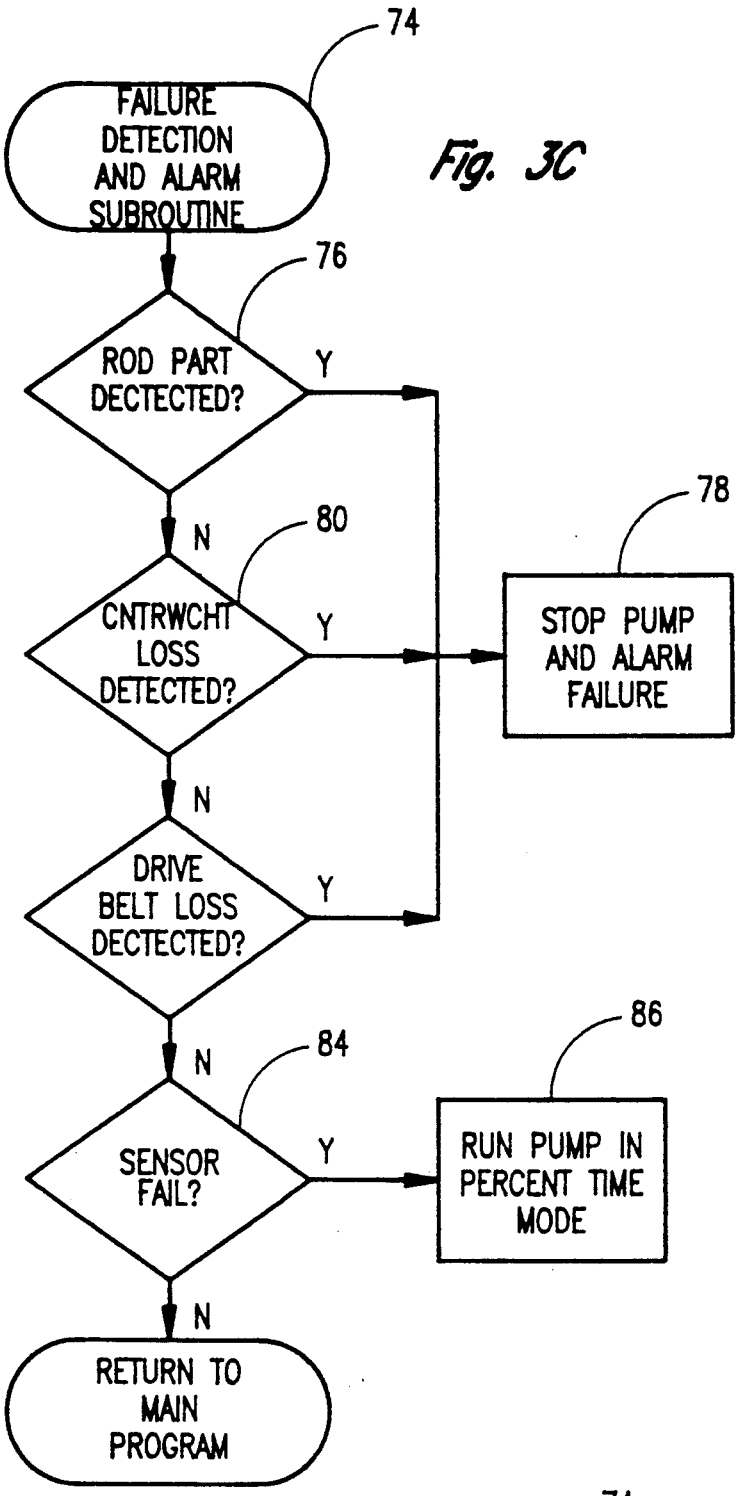

Thereafter, the data collection process will begin as illustrated in the flow chart on FIG. 3B. A failure detection and alarm subroutine 74 will occur next, as shown in box 74. The failure detection subroutine is set forth in FIG. 3C. A sucker rod failure or part is known to impart a gross out-of-balance condition to the well pump apparatus. Under normal operating conditions, counterbalance weights will offset the weight of the sucker rod string to present a somewhat balanced load to the electric motor. When the system is in balance, the maximum upstroke current will roughly approximate the maximum downstroke current peak. In the event of a rod failure or part, however, the motor is presented with the task of lifting the counterweights without the benefit of the counter veiling weight of the rod string. Since the counterweights are being lifted on the downstroke, the amplitude of the motor current peak is inordinately high in comparison to the amplitude of the upstroke motor current peak. Recognition of this characteristic of a rod failure as shown in box 76 will signal the microprocessor to stop the motor and provide an alarm as depicted in box 78. The microprocessor 50 will stop the apparatus through a signal from discrete output 62 through line 64 to motor control relay 58.

Stated another way, if a rod breaks as depicted in box 76, work that must be done on the one-half of the stroke is greatly increased compared to the other half of the stroke. If this occurs, the peak motor current is much different on the upstroke versus the downstroke. If the peak motor currents are more than a set percentage different, such as 25%, then it is considered a mechanical failure and the motor is stopped immediately and an alarm is activated.

A provision to detect counterweight loss or movement is also made as shown in box 80. It is known that the counterweight or counterweights sometimes come lose and move and, from time-to-time, may fall off the crank arm 32. As the counterweights work their way off the crank arm, the well pump apparatus becomes more and more out of balance. Detection of this phenomenon is virtually impossible with conventional rod load versus position load systems, since the sensors do not look at the entire apparatus as a system. The symptoms of counterweight loss or movement are exactly the inverse of rod failure. The motor is trying to lift the rod string without the benefit of the counterweights and, therefore, the maximum amplitude of the upstroke motor current peak will be much higher than the maximum amplitude of the downstroke motor current peak. If the peak motor currents are more than a set percentage different, the microprocessor 50 will cause the relay mechanism to stop the motor immediately and activate an alarm in the form of an audio and/or visual output signal. By stopping the motor, further damage or waste of energy is avoided.

The present invention will also monitor the well pump apparatus to see if a loss of the drive belt 36 has occurred. When the microprocessor has started the motor (recall start pump command 74), the motor current is checked for a non-zero value. If the motor current is of some modulated value, it is assumed that there is a good start sequence. Conversely, if the motor current is zero, the microprocessor will assume that there is a failure and an alarm is activated. In the event that the drive belt breaks or falls off, the motor current will have a non-zero value but will be stable and a lower than normal value. Because specific changes in the motor current are not sensed, the relay mechanism will stop the motor and an alarm activated. In the present embodiment, if the motor peak current is less than five amps for any one sample and the proximity sensor is not detected for twenty seconds, the motor will be stopped and the alarm activated.

If either the motor current sensor fails or the proximity sensor fails, the motor may then be operated in the percent run mode as seen in the flow charts in the boxes 84 and 86. This mode will remain in effect until the operator (not shown) resets the system. The percent run mode consists of running the motor for the average time of the last ten pump cycles (the time from which the motor is started until the motor is stopped due to a pump-off condition) followed by shutting off the motor for the calculated fill time or a manual fill time. This will be described in detail below. This sequence is repeated until an operator resets the microprocessor to return to its "normal" behavior as shown in the flow charts herein. The reset operation may be performed as an operator command that may be password protected.

Following this failure detection and alarm subroutine 74, the main process (FIG. 3B) is continued.

Figure 3D:
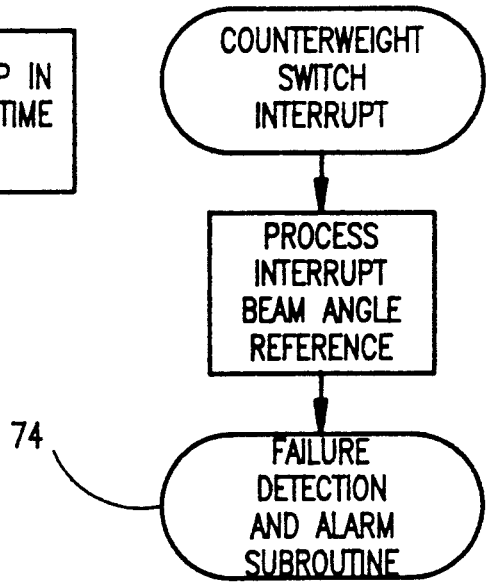

The counterweight sensor is thereafter utilized to determine the beam angle of the crank arm 32. As seen in FIG. 3D, the counterweight sensor 52 will provide an interrupt when the crank arm passes adjacent the sensor 52.

Returning to the flow chart of FIG. 3B, the failure detection subroutine 74 is again performed.

Thereafter, by use of the counterweight sensor 52, it is determined that the polish rod 16 is in the upstroke as shown by box 88.

Following this procedure, the data collection begins as illustrated by box 90.

A motor current peak value is acquired every ten milliseconds by the electrical current sensor 44. This data is transmitted through line 46 and is stored in the microprocessor 50 in a buffer which is long enough to hold up to fifteen seconds or at least a single stroke's worth of data. The point at which the counterweight sensor interrupt is generated is also saved so that it can be associated with a point on the buffer. With this data collection, the maximum upstroke current is saved and maximum downstroke current is saved. The data is then partitioned based on the sensor into an upstroke and downstroke current. The peak upstroke motor current and the peak downstroke motor current is thus determined as indicated in boxes 92 and 94.

The sum of the motor current samples obtained between each current peak is then calculated. The sum of the motor currents is divided by the time period between the upstroke and downstroke peak. A number of amperes per second is derived. The number derived is called the analysis current per second (ANIS) as seen in the flow chart at box 96. As the motor continues to run and the pump apparatus continues to operate, continuous ANIS samples are taken, received and recorded in the microprocessor 50. The samples are recorded or loaded in a first in, first out buffer as shown in box 98.

The calculation of the standard deviation of the ten samples is shown at box 100. The standard deviation or variance from the norm is calculated using known statistical methods. The standard deviation gives a numerical value to the clustering tendency of the data. The standard deviation is the positive square root of the variance.

Continuing with the process shown in the flow charts, the mean or average value of the ten samples is calculated, as shown at box 102. If the last sample is less than two standard deviations from the mean, the sample will be considered a valid one to be used for a control decisions (as will be discussed herein). If the last sample is greater than two standard deviations from the mean (see box 104), the sample will be considered invalid and will not be used for a control decision. As illustrated by box 106, the data sample will not be used. Rather, the data collection process will begin again with the failure detection subroutine 74.

If the sample is valid for a control decision, as in box 108, the pump-off detection procedure is performed as fully shown in FIG. 3A.

A set point has been programmed in advance either by the operator or by previously established values. This will often be a default number from previous observations. This is used as a threshold set point as shown on box 110. If the last sample or samples are not less than the threshold set point, the samples will not be used for the pump-off determination and the process returns the data selection procedure of FIG. 3B. If the ANIS samples are less than the threshold's set point, the process continues.

The determination of a gas lock condition (see box 112) is next determined. Gas lock is generally a transient condition lasting for only a few strokes. The ANIS number will illustrate this condition as a low value for the sample or samples which is outside of the two standard deviation limit for useable samples. The ANIS number sample or samples shows the gas lock condition dramatically as a low value. However, since the value or values are statistically insignificant, they are not deemed valid to determine a pump-off condition.

For each statistically significant sample less than the pump-off point threshold, the fluid pound count is increased by one. Finally, the motor is shut off due to a pump off condition achieved as shown in box 114. Thus, upon a sufficient number of consecutive ANIS samples falling below a preselected threshold, the well is deemed to be pumped-off. That is, the pump apparatus is no longer pumping oil to the surface due to starvation of the pump.

As the well apparatus pumps-off, the ANIS number goes downward, indicating that the pump system is drawing the level of fluid downward in the bore of the well. When the ANIS number is as low as it will get, it can be assumed that the well apparatus is in a pumped off condition. The pump is no longer lifting fluid since it is drawn down the fluid level to the bore to a point that is below that that is required for the pump to fill.

Figure 3E:
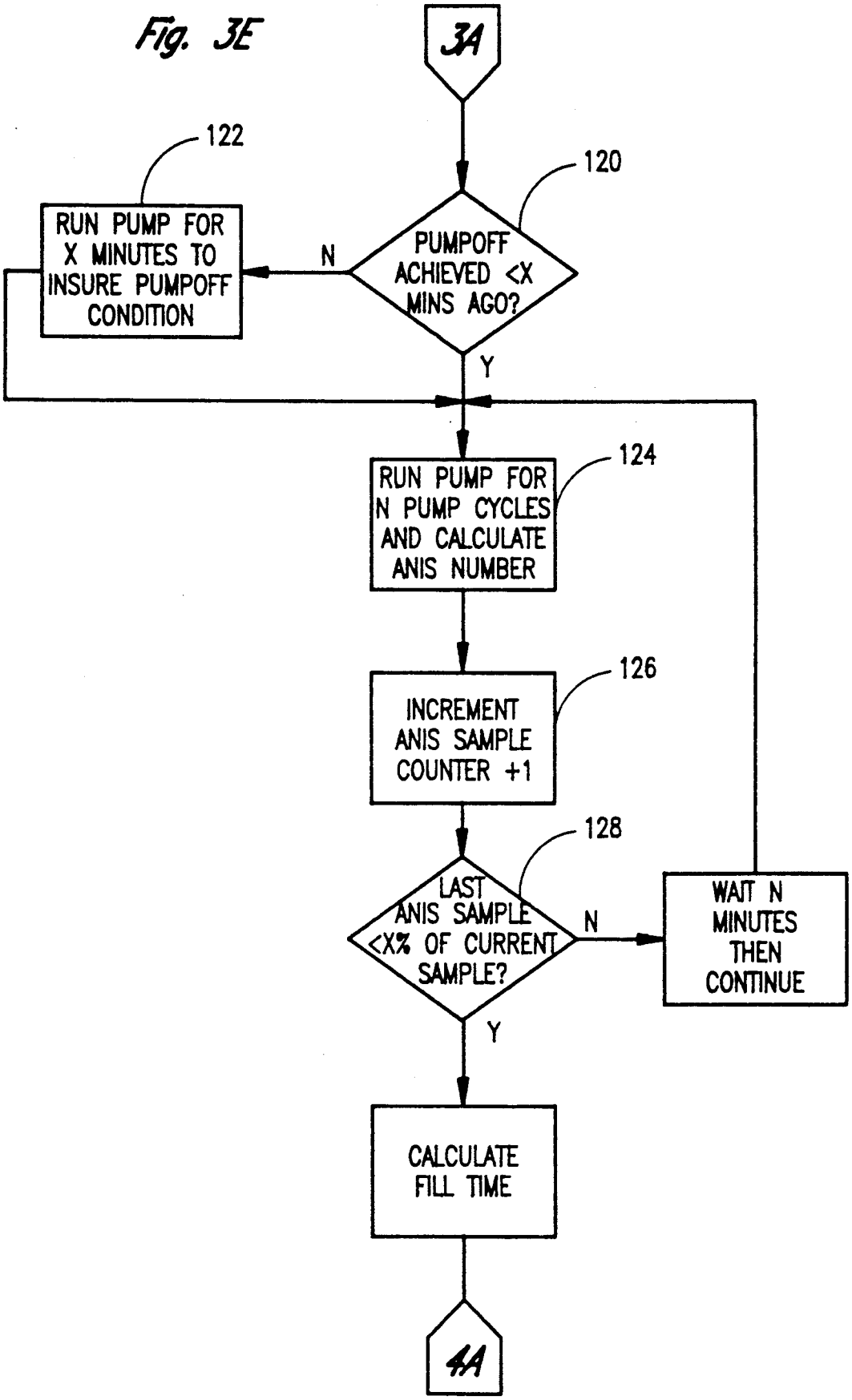

The optimal amount of fill time can be calibrated, as shown by box 116. If the fill time optimizer will not be calibrated, the fill time timer may be in a time-out mode (see box 118) after which the procedure will return to the start as shown on the flow chart. The calibration of the fill time optimizer is seen in FIG. 3E. Initially, it will be determined whether the pump off, or time of motor stopping has been achieved less than a certain number of minutes before as seen in box 120. If this has not occurred, the motor will run for a set period to insure the pump off condition as indicated by box 122.

Further pumping action is delayed for a uniform short length of time, such as five minutes. After this uniform short length of time, the microprocessor will signal the relay mechanism to start the motor and the pump apparatus will operate through a number of strokes or cycles. An ANIS number will be determined, as indicated in box 124 and as previously described in detail. Next, the second period of delay occurs for a uniform short length of time, the same selected short length of time as the first period, such as five minutes. After the second delay, the motor is again restarted and the well pump apparatus is operated to calculate an ANIS number. This sequence is followed for a number of times. The ANIS values are collected periodically. The ANIS samples are incremented sequentially, see box 126. The periodic sequential values are compared to each other and the difference between the most current sample and the previous sample obtained is noted. It will be observed that the rate of fill decreases with time as the well bore comes into dynamic equilibrium with the formation. The ANIS values comes in closer and closer to one another as fill time continues. The optimum time to cease waiting for fill and begin the motor is when the fill rate starts to diminish. When the last ANIS sample is less than a certain percentage of the current sample, the fill time has been optimized, as depicted in box 128. Finally, the fill time is calculated in minutes after which the procedure begins again as seen in FIG. 3A so that the motor will start as seen in boxes 72 and 74.

It will thus be appreciated that by applying statistical analysis techniques to data from the current sensor mechanism and the counterweight position indicator, the optimum pumping cycle and optimum fill time can be determined, gas lock and pumped off conditions can be differentiated, rod failure and counterweight failure can be determined, and motor failure and belt failure can be determined.

Whereas, the present invention has been described in relation to the drawings attached hereto, it should be understood that other and further modifications, apart from those shown or suggested herein, may be made within the spirit and scope of this invention.

What is claimed is:

1. A method of monitoring and controlling a well pump apparatus having an electric motor that rotates a crank arm having a counterweight thereon, a pivoted walking beam oscillated by said crank arm which reciprocates a sucker rod and a pump between an upstroke and a downstroke, which method comprises:

a. measuring electric current from said motor periodically between the peak upstroke motor current and the peak downstroke current, and integrating the results to deduce an analysis current per period;

b. calculating the mean of a number of sequential samples of said analysis current per period and thereafter calculating the standard deviation;

c. determining that the last said sample is within two standard deviations of said mean in order to proceed with the process; and d. stopping said well pump apparatus if a selected number of consecutive analysis current per period samples fall below a preselected arbitrary threshold.

2. A method of monitoring and controlling a well pump as set forth in claim 1 wherein said electric current is measured every ten milliseconds.

3. A method of monitoring and controlling a well pump as set forth in claim 1 wherein ten said sequential samples of said analysis currents per period are utilized.

4. A method of monitoring and controlling a well pump as set forth in claim 1 wherein said sequential samples of analysis current per period are discarded if the last sample greater than two standard deviations from the mean.

5. A method of monitoring and controlling a well pump as set forth in claim 1 including determining the optimum fill time through the additional steps of;

starting said well pump periodically for short durations after said stopping of said well pump to determine an analysis current per period; and thereafter starting said well pump after determining that the difference between adjacent analysis current per period is less than a preselected set point.

6. A method of monitoring and controlling a well pump as set forth in claim including determining said upstroke and said downstroke through use of a proximity sensor located adjacent the path of said crank arm.

7. A method of monitoring and controlling a well pump apparatus as set forth in claim 1 including the additional step of stopping said motor if the motor current peak falls below a preselected current.

8. A method of monitoring and controlling a well pump apparatus as set forth in claim 1 including the additional steps of:

comparing the peak upstroke current to the peak downstroke current; and stopping said well pump apparatus if said peak currents vary by more than a preselected percentage.

9. A method of monitoring and controlling a well pump apparatus as set forth in claim 8 wherein said preselected percentage is 25 percent.

10. A method of monitoring and controlling a well pump apparatus to initiate a production pumping cycle, the well pump apparatus having an electric motor that rotates a crank arm having a counterweight thereon, a pivoted walking beam oscillated by said crank arm which reciprocates a sucker rod and pump, which method comprises:

a. starting said electric motor periodically for short pumping durations to take samples;

b. measuring electric current from said motor periodically between the peak upstroke current and peak downstroke current during each short pumping duration, summing the results and dividing by the time period between said peaks to deduce an analysis current per each short pumping duration;

c. comparing the analysis current derived for the most recent short pumping duration with the analysis current derived from the previous short pumping duration; and d. initiating a production pumping cycle when the difference between adjacent analysis current is less than a preselected set point.

11. A method of monitoring and controlling a well pump as set forth in claim 10 wherein said electric current is measured every ten milliseconds.

12. A method of monitoring and controlling a well pump as set forth in claim 10 including determining said upstroke and said downstroke through use of a proximity sensor locating adjacent the path of said crank arm.

13. A method of monitoring and controlling a well pump apparatus as set forth in claim 10 including the additional steps of:

comparing the peak upstroke current to the peak downstroke current; and stopping said well pump apparatus if said peak currents vary by more than a preselected percentage.

14. A method of monitoring and controlling a well pump apparatus as set forth in claim 10 wherein said preselected percentage is 25 percent.

15. A method of monitoring and controlling a well pump apparatus as set forth in claim 10 including the additional step of stopping said motor if the motor current peak falls below a preselected current.

16. A method of monitoring and controlling a well pump apparatus having an electric motor that rotates a crank arm having a counterweight thereon, a pivoted walking beam oscillated by said crank arm which reciprocates a sucker rod and a pump between an upstroke and a downstroke, which method comprises:

a. measuring electric current consumed by said electric motor with an electrical current sensor and determining the peak upstroke motor current and the peak downstroke motor current;

b. measuring said electric current periodically and comparing the peak upstroke current to the peak downstroke current; and c. stopping said well pump apparatus if said peak currents vary by more than a preselected percentage.

* * * * *